US009770124B2

(12) United States Patent
Singer

(10) Patent No.: US 9,770,124 B2
(45) Date of Patent: Sep. 26, 2017

(54) PICTURE FRAME AND STORAGE DEVICE

(76) Inventor: Charles Howard Singer, Bedford, NY (US)

( * ) Notice: Subject to any disclaimer, the term of this patent is extended or adjusted under 35 U.S.C. 154(b) by 1035 days.

(21) Appl. No.: 13/249,295

(22) Filed: Sep. 30, 2011

(65) Prior Publication Data

US 2012/0079751 A1 Apr. 5, 2012

Related U.S. Application Data

(60) Provisional application No. 61/389,347, filed on Oct. 4, 2010.

(51) Int. Cl.
*A47G 1/06* (2006.01)

(52) U.S. Cl.
CPC ..... *A47G 1/06* (2013.01); *A47G 2001/0688* (2013.01); *A47G 2001/0694* (2013.01)

(58) Field of Classification Search
CPC .... A47G 1/06; A47G 1/14; G09F 1/12; B42F 7/14
USPC ..... 70/721; 40/312, 794, 721, 723, 724
See application file for complete search history.

(56) References Cited

U.S. PATENT DOCUMENTS 1,068,621 A * 7/1913 Abraham ..... 40/721
1,923,064 A * 8/1933 Bracken ..... 206/559
1,980,687 A * 11/1934 Lassen ..... 40/312
2,154,959 A * 4/1939 Roose ..... 40/626
2,510,629 A * 6/1950 Golden ..... 40/721
2,839,857 A * 6/1958 Teller ..... 40/721
3,254,927 A * 6/1966 Harvey ..... 312/9.9
3,554,429 A * 1/1971 Cohen ..... 229/120.34
3,645,024 A * 2/1972 Herrin et al. ..... 40/800
4,117,613 A * 10/1978 Hosker ..... 40/735
4,261,122 A * 4/1981 LeVine ..... 40/711
4,854,464 A * 8/1989 Kim ..... 220/528
5,400,532 A * 3/1995 Grove ..... 40/721
6,202,838 B1 * 3/2001 Tran ..... 206/232
D451,290 S * 12/2001 Allen ..... D6/300
6,959,508 B2 * 11/2005 Watkins et al. ..... 40/641
2004/0035039 A1 * 2/2004 Bilinszky ..... 40/722
2004/0134111 A1 * 7/2004 Berg ..... 40/721
2006/0162213 A1 * 7/2006 Einarson ..... 40/765
2009/0300960 A1 * 12/2009 Broehl et al. ..... 40/721

FOREIGN PATENT DOCUMENTS

JP 11348482 A * 12/1999

* cited by examiner

*Primary Examiner* — Cassandra David
(74) *Attorney, Agent, or Firm* — Richard Mark Blank, Esq.

(57) ABSTRACT

The picture display and storage device or frame of the present invention has a displaying surface for displaying a picture and a storage section for storing additional pictures. The storage section is not visible when viewing the displaying surface. The picture display and storage device can be exhibited by hanging on a wall or through the use of an easel frame or a wide base to allow the frame to stand on its own. Additionally, the picture display and storage device can utilize organizer tabs to separate and identify pictures being stored.

5 Claims, 5 Drawing Sheets

PICTURE FRAME AND STORAGE DEVICE

This application claims the benefit under 35 U.S.C. 119(e) of U.S. provisional Application No. 61/389,347, having a filing date of Oct. 4, 2010.

FIELD OF THE INVENTION

The present invention relates to a picture frame that can be used to both display and store pictures. The picture frame and storage device can also be used to separate stored pictures and identify them.

BACKGROUND OF THE INVENTION

There have been picture frames and picture storage devices. There have been combinations of picture frames with storage. However, none of these combination devices effectively hide the storage portion from view of the picture frame display portion, or can be exhibited on a wall or free-standing, or utilize organizer tabs for ease of finding and referencing the stored pictures, as can be found in various embodiments of the present invention.

U.S. Pat. No. 4,415,079, entitled, "Holder for photographic prints", recites, according to its Abstract "[a] holder for accommodating a variable number of photographic prints comprises a housing having a viewing window against which the uppermost print is resiliently biased. The holder includes a slide which may be partially withdrawn therefrom to gain access to the prints, the resilient bias being suppressed during withdrawal of the slide." Abstract, U.S. Pat. No. 4,415,079.

U.S. Pat. No. 4,139,097, entitled, "Stackable container tray for storing and displaying flat objects", recites, according to its Abstract, "[a] semi-transparent, tray-like container having a flat bottom and substantially vertical side and end walls defining a storage space has flange-like projections on each side wall inner surface in proximity to but spaced from the bottom to define, with the bottom, a retaining channel which slidably receives a removable panel assembly containing a plurality of hinged overlapping transparent envelopes which can be flipped like pages to display flat objects such as photography, stamps, recipes and the like contained therein." Abstract, U.S. Pat. No. 4,139,097.

U.S. Pat. No. 7,140,137, entitled, "Spring loaded holders", recites, according to its Abstract, "[a] spring loaded holder with a holder plate which is rotatable between a deactivated zone and an activated zone. When the holder plate is manually moved to the activated zone a cam action will be activated to apply a holding force to the holder plate for firmly holding objects of varied thickness. Such holders can be installed in a picture frame for holding a stack of art sheets." Abstract, U.S. Pat. No. 7,140,137.

U.S. Pat. No. 5,038,935, entitled, "Storage and display unit for photographic prints", recites, according to its Abstract, "[a] photographic print and storage unit includes a frame and a tray. A stack of photographs is held within the tray and against the frame by a set of stack lifting members activated when the frame and tray are closed." Abstract, U.S. Pat. No. 5,038,935.

U.S. Pat. No. 6,349,494, entitled, "Quick change display apparatus", recites, according to its Abstract, "[a] display apparatus for a display has first member with four sides. The display apparatus includes a transparent restraining member mounted centrally within the four sides of the first member. A second member having four sides and a back is rotatably interconnected with the first member such that the first member can articulate between a first position and a second position. The display apparatus includes holding devices for holding the display as the first member moves from the first to the second position and back to the first position. At least one biasing device exerts an urging pressure for urging the display against the transparent restraining member when the first member is in the first position. The biasing device is preferably a compressible material with memory. The material lies adjacent to the display, distributing the urging pressure along a continuous portion of the display, substantially from one edge to an opposing edge, while the first member is in the closed position. The display apparatus also includes at least one retainer for retaining the biasing device within the second member. The retainer forms a wall of a storage construct within the second member." Abstract, U.S. Pat. No. 6,349,494.

U.S. Pat. No. 5,068,987, entitled, "Picture display receptacle", recites, according to its Abstract, "[t]his invention concerns a box (receptacle) for holding and displaying photographs, in the form of a somewhat flattened parallelepiped, inside which one or more tidily stacked photographs of suitable format can fit exactly, and the first of which, starting from the top of the pile, is clearly visible from the outside of the box, in that the lid of the latter possesses a sizeable central window closed by a sheet of transparent material, thus obtaining the optical effect of making said photograph-holding box into a simple photograph frame, without giving any clues that would enable its primary function as a photograph holder to be seen or surmised." Abstract, U.S. Pat. No. 5,068,987.

SUMMARY OF THE INVENTION

The picture display and storage device or frame of the present invention has a displaying surface for displaying a picture and a storage section for storing additional pictures. The storage section is not visible when viewing the displaying surface. The picture display and storage device can be exhibited by hanging on a wall or through the use of an easel frame or a wide base to allow the frame to stand on its own. Additionally, the picture display and storage device can utilize organizer tabs to separate and identify pictures being stored.

BRIEF DESCRIPTION OF THE DRAWINGS

The present invention will be more readily understandable from a consideration of the accompanying drawings in which.

DETAILED DESCRIPTION OF THE INVENTION

The picture frame and storage device of the invention includes a picture frame for displaying a picture, e.g., a photograph or other piece of art, and space for storing additional pictures as well.

Figure 1:
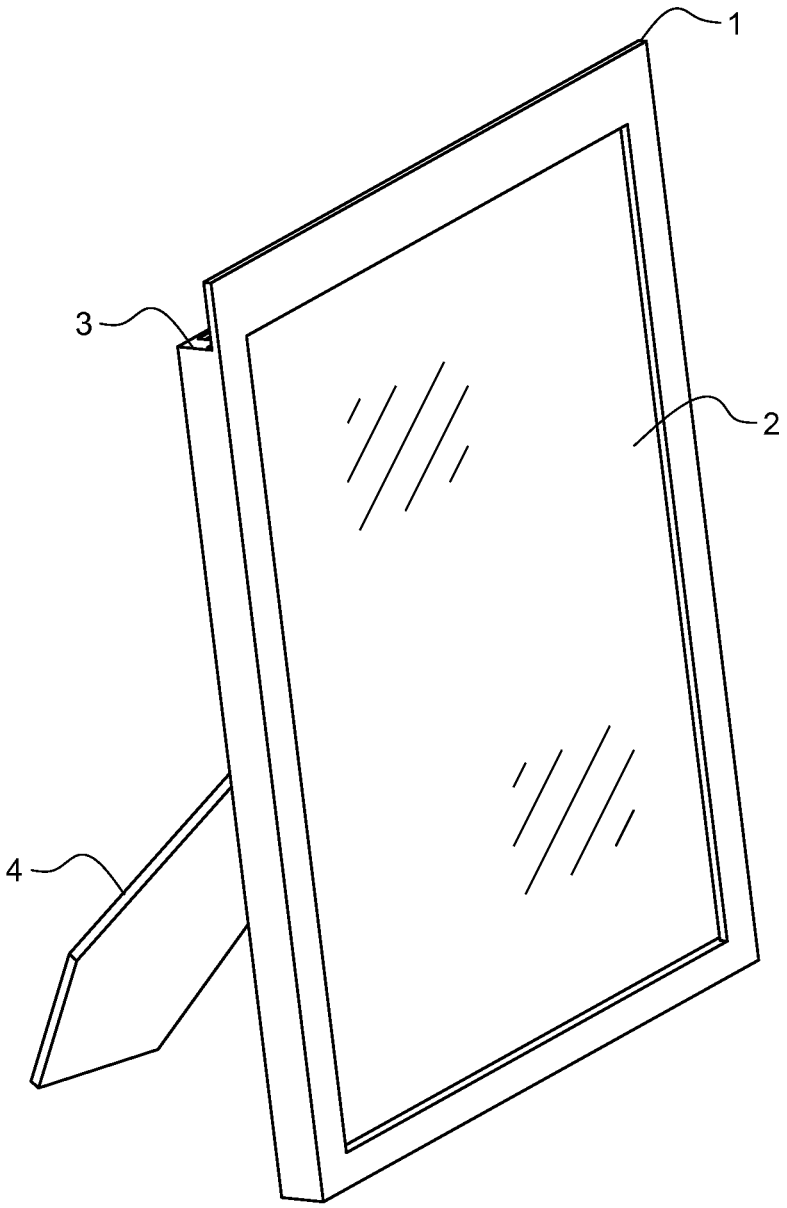
FIG. 1 is a perspective view of the front of an embodiment of the picture frame and storage device.

In FIG. 1, the picture frame and storage device 1 has a viewing window 2, storage space 3 and easel back 4.

Figure 2:
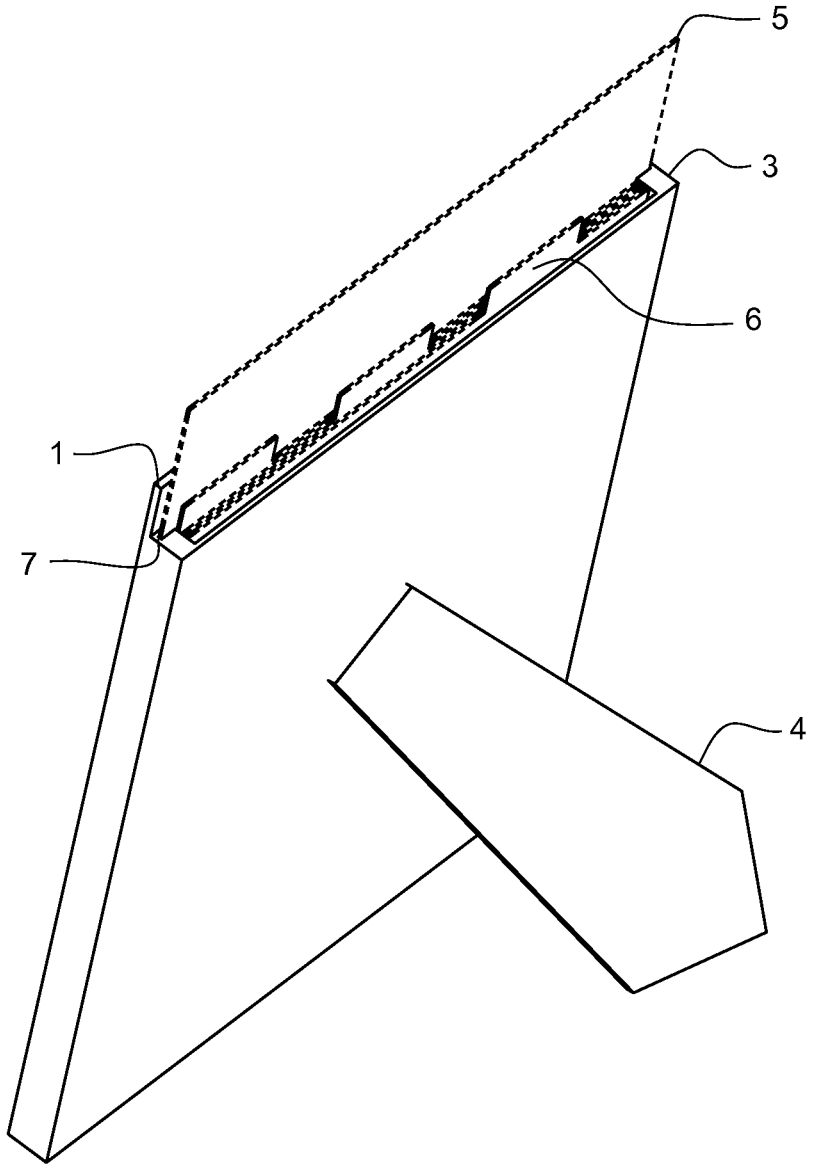
FIG. 2 is a perspective view of the back of an embodiment of the picture frame and storage device.

The picture frame and storage device of FIG. 2 includes a partition or wall 5 to separate the picture(s) in the viewing window from a picture(s) and organizing tabs 6. The partition or wall 5 operates to stabilize the picture in the viewing window. Grooves 7 can be used to hold the partition or wall 5 in place.

Figure 3:
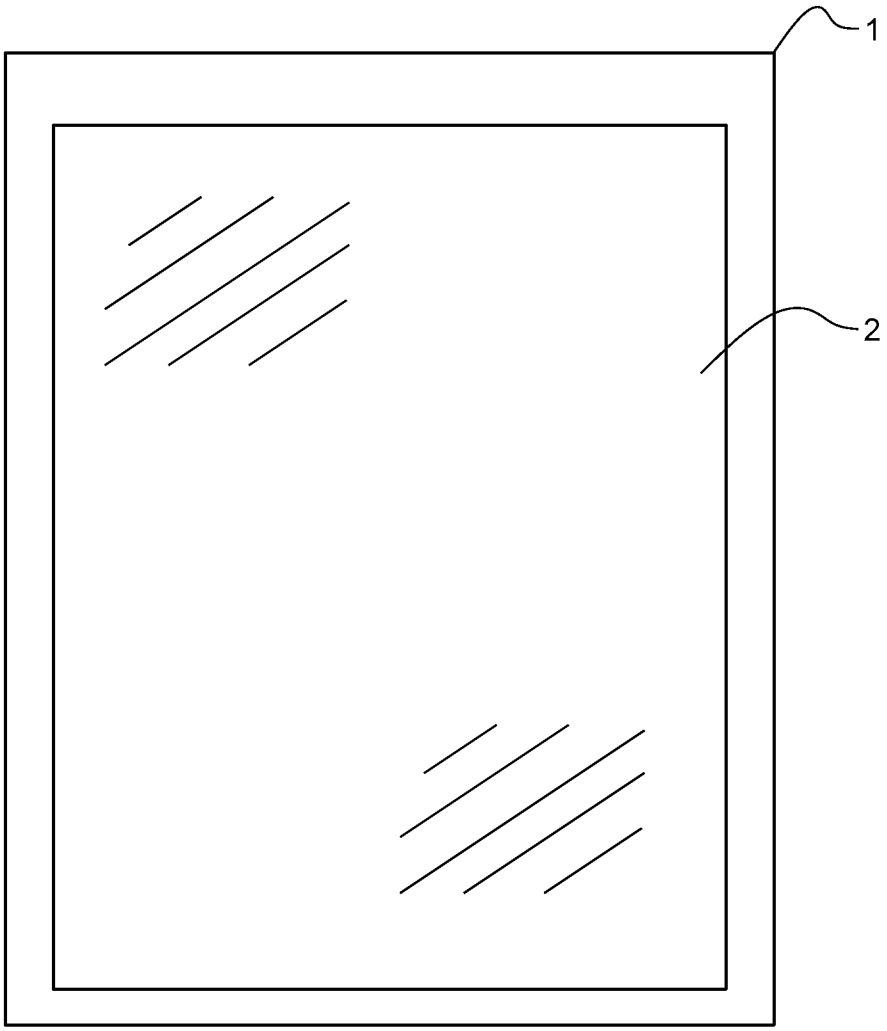
FIG. 3 is a front view of an embodiment of the picture frame and storage device.
Figure 4:
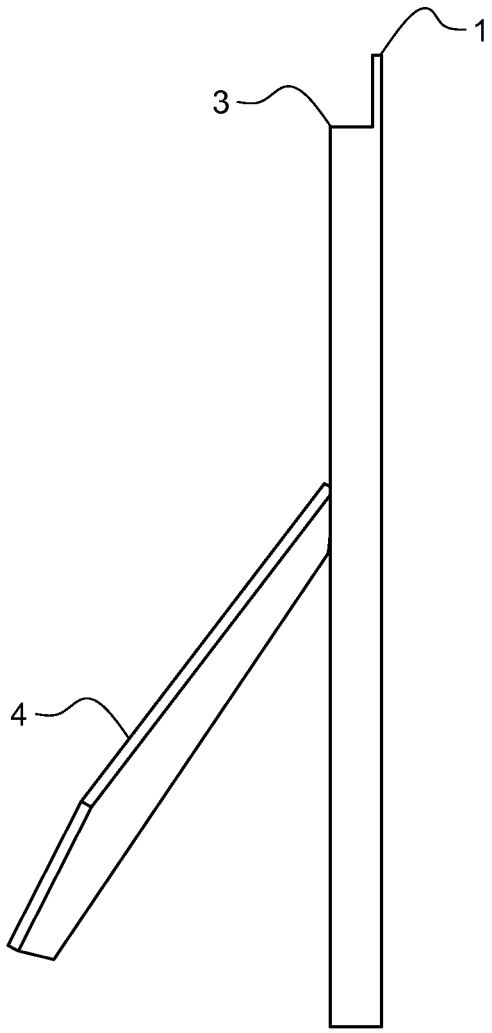
FIG. 4 is a side view of an embodiment of the picture frame and storage device.
Figure 5:
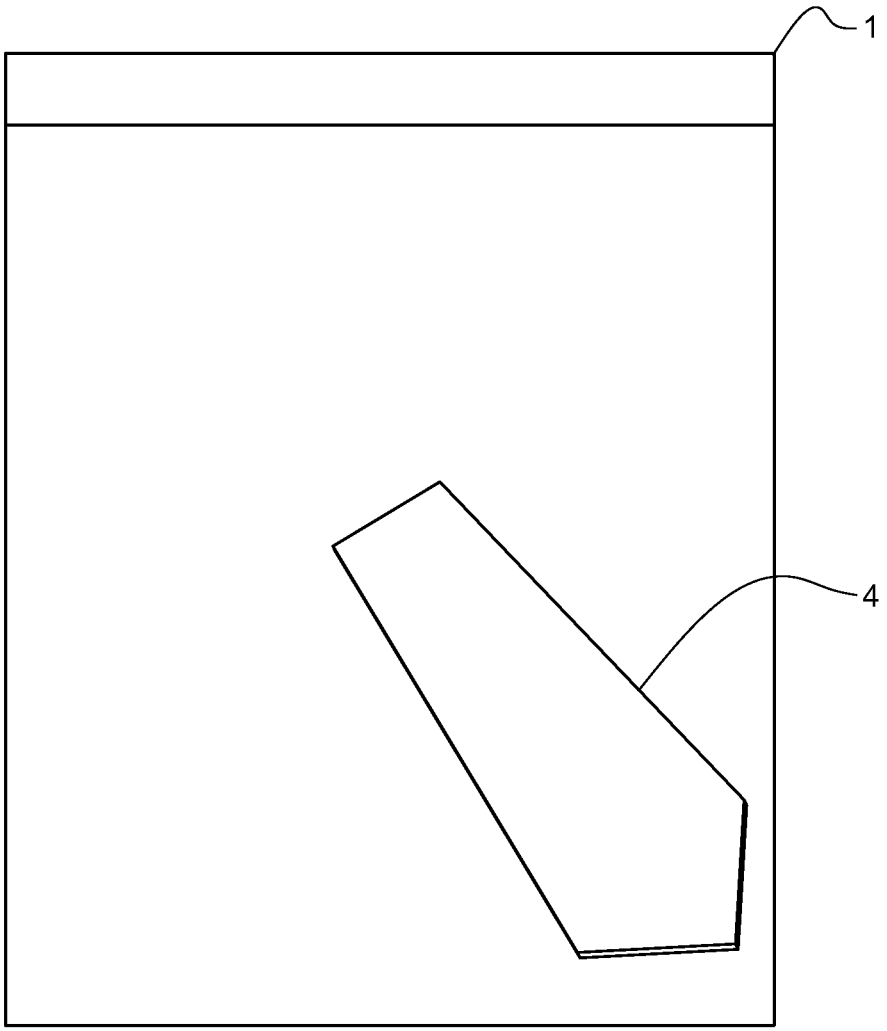
FIG. 5 is a rear view of an embodiment of the picture frame and storage device.

FIG. 3 includes a large viewing window 2. FIG. 4 shows more of the easel back 4 of FIG. 1.

The storage area 3 forms the back of the frame in FIG. 4. Alternatively, a storage area is attached to the back of the frame. In either case, the storage area forms a rear surface of the frame, so that it is not visible from the front of the frame. The storage area does not extend past the dimensions of the front of the frame, so that it is not visible from the front of the frame. Also, the storage area has an easily accessible opening in the side or top thereof and can also have a cover for the opening. In one example, the storage area 3 is between ½ inch to ¾ inch deep and fits 10 to 20 pictures and organizer tabs.

Additionally, the storage area has a means for separating the stored pictures to ease the handling thereof. The means for separating can also include a means for identifying the stored pictures to make it easier to chose a picture for display. The means for separating, in one embodiment, can also be made so it is visible from the back and the side of the frame, but not from the front of the frame.

The means for identifying the stored pictures can be in the form of organizer tabs 6, that can also serve a dual purpose as the means for separating the pictures. These organizer tabs do not extend past the top of the frame and, thus, are not visible from the front of the frame, thereby not interfering with the aesthetic qualities of the frame.

In one embodiment, the frame includes grooves or channels for storing pictures, so that the storage area is the frame itself or a part of the frame. Each groove or channel is sized for holding a predetermined number of pictures. The grooves or channels can also hold organizer tabs or the organizer tabs can be placed in between the sets of grooves or channels.

The storage frame 1 has a front surface with a viewing window 2, through which the forward most picture can be displayed and viewed. The viewing window can be an open space or it can include a transparent material, e.g., plastic or glass, for protecting the picture being displayed. Preferably, the transparent material can slide in and out of the viewing window.

The forward most picture which is being displayed is preferably held in place at the viewing window by a means for holding. Such means for holding can include a groove or channel for the picture to be pressed into or slid into such that the walls of the groove or channel hold the picture in place. Further, the pictures being stored in the back of the frame can exert a force on the picture being displayed such that the displayed picture is pushed against the viewing window. In this way, the pictures being stored form the means for holding.

Other means for holding can include at least one biasing device that exerts pressure for urging the displayed picture against the viewing window. One example of a biasing device is wall or partition 5 located behind the displayed picture. The partition can be made of any solid material, e.g., e.g., plastic, wood, or metal. Examples of a biasing device are also described in US Patent Application No. 20090119965 and U.S. Pat. No. 6,349,494 (in which the biasing device is preferably a compressible material with memory), both of which are incorporated by reference herein.

Other means for holding can include a clip spring in the frame storage area to exert forward pressure to urge the display picture against the viewing window.

Other means for holding can include at least one retention member as in US Patent Application No. 20040134111, which is incorporated by reference herein. In adapting US Patent Application No. 20040134111 to the present invention, the at least one retention member would extend from a rear wall of the storage area and wholly or partially into the frame or storage area for holding the picture against the viewing window.

The frame can be displayed by hanging on a wall via a recess in the rear surface of the frame (the rear surface of the storage area) or via hanging hardware. It can also be displayed on a surface through the use of an easel frame or a wide base to allow the frame to stand on such surface, such as a desk or a table.

The frame can be used in a portrait orientation or a landscape orientation.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A picture frame, comprising: a front surface with a viewing window that includes open space or transparent material for displaying a picture; a storage section with an open top for storing additional pictures, the storage section being attached to the front surface, the storage section not being visible when viewing the displaying surface from the front; a removable partition for separating the displayed pictures from pictures in the storage section and for holding in place the forward most pictures in the viewing window, the storage section containing removable divider tabs for labeling, identifying, organizing, and separating stored pictures; an attached means for exhibiting the frame, the means for exhibiting the frame being an easel frame to allow the frame to stand on its own; and a recess or hanging hardware on the frame's back for the purposes of hanging up the frame.

2. The picture frame of claim 1 wherein the viewing window is made of plastic.

3. The picture frame of claim 1 wherein the viewing window is made of glass.

4. The picture frame of claim 1 wherein the storage area is between ½ inch and ¾ inch deep and fits 10 to 20 pictures and organizer tabs for the purposes of ensuring the frame is light enough to be hung up.

5. The picture frame of claim 1 further comprising grooves for holding the partitions in place.

* * * * *